US005655292A

United States Patent [19]

Fisher et al.

[11] Patent Number: 5,655,292

[45] Date of Patent: Aug. 12, 1997

[54] METHOD FOR ASSEMBLING A FUSE HOLDER

[75] Inventors: John L. Fisher, Lexington; J. Donald Richerson, Versailles; Ronald F. Dornbrock, Versailles; John E. Cloyd, Versailles; Stephen D. Smith, Lawrenceburg, all of Ky.

[73] Assignee: Kuhlman Electric Corporation, Versailles, Ky.

[21] Appl. No.: 460,325

[22] Filed: Jun. 2, 1995

Related U.S. Application Data

[62] Division of Ser. No. 210,838, Mar. 21, 1994, Pat. No. 5,576,682.

[51] Int. Cl.[6] ..... H01R 43/02; H01R 43/04

[52] U.S. Cl. ..... 29/845; 29/877; 29/881; 29/882; 29/623

[58] Field of Search ..... 29/844, 845, 876, 29/877, 881, 882, 619, 623; 337/186, 201, 204, 205, 213

[56] References Cited

U.S. PATENT DOCUMENTS

| | | |
|---|---|---|
| 3,628,092 | 12/1971 | Keto . |
| 3,699,490 | 10/1972 | Macemon . |
| 3,775,207 | 11/1973 | Harmon . |
| 3,827,011 | 7/1974 | Braunstein . |
| 3,829,810 | 8/1974 | Giegerich . |
| 4,044,326 | 8/1977 | Rodrigues . |
| 4,081,778 | 3/1978 | Sack et al. . |
| 4,321,576 | 3/1982 | Lien . |

OTHER PUBLICATIONS

Photographs and photocopies of photographs of ABB Fuse Holder, I.D. 455B726G02, made by ABB Power T&D Company, Inc., (Asea Brown Boveri) Bluebell, PA 19422.

Photographs, photocopies of photographs and product literature dated Nov., 1982 for McGraw–Edison Power Systems Division Fusing Apparatus OEM 300–58.

Photographs, photocopies of photographs and 2 pages of product description of General Electric Submersible Dry–Well Fuseholder dated Jun. 1980.

Product literature and assembly drawing of Current Limiting Fuse Holder dated Aug. 1981.

*Primary Examiner*—P. W. Echols

*Attorney, Agent, or Firm*—Townsend and Townsend and Crew LLP

[57] ABSTRACT

A fuse holder (2) for use in electrical apparatus includes a tubular body (6) having outer and inner ends (10, 16). A first electrical contact element (22) and a mounting flange (8) are secured to the inner and outer ends, preferably using resilient retaining rings (53, 68) engaging circular grooves (52, 20; 62, 20) formed in the opposed surfaces. A tubular second electrical contact element (32) is secured within the tubular body and preferably has a flexible electrical terminal strap (24) which extends out through an opening (23) formed in the tubular body. Fluid-tight seals are provided between the inner surface (14) of the tubular body and the outer surfaces (46, 58, 30) of the first and second electrical contact elements and the mounting flange assembly by using pairs of O-rings (38, 50 and 70); an adhesive (39) is also used to secure these elements to the body.

10 Claims, 2 Drawing Sheets

METHOD FOR ASSEMBLING A FUSE HOLDER

This is a division of application Ser. No. 08/210,838 filed Mar. 21, 1994 now U.S. Pat. No 5,576,682.

BACKGROUND OF THE INVENTION

Electrical equipment, as well as the primary feed circuits to which the electrical equipment is connected, is protected against excessively high fault currents by use of current limiting fuses. One type of such fuse is housed within a fuse holder designed specially for electrical equipment such as transformers and primary switch/fuse modules serving pad mounted and underground service applications. This type of fuse holder is an externally operated design which accommodates the small space typically available with pad mounted and underground equipment. The current limiting fuses often used with these fuse holders are very sensitive to oil and moisture leaks. Fuse holders are subjected to hot transformer oil immersion within the transformer or switch and to ambient weather conditions outside the transformer or switch. A fuse holder which does not provide good hermetic seals can cause the top closure or cap of the fuse holder to be expulsed quite rapidly due to the creation of gases within the fuse holder when the fuse operates.

Conventional fuse holders include wet wound type fuse holders, such as those made by Kuhlman Electric Corporation of Versailles, Kentucky and by the General Electric Company of Hickory, N.C. Construction of these fuse holders include a first contact at the distal or inner end of the fuse holder, a second contact spaced axially along the length of the fuse holder and a mounting flange at the proximal or outer end of the fuse holder. The main body of the tube is made by wet winding resin-impregnated fibers around a mandrel, the electrical contacts and the mounting flange.

Another type of fuse holder uses a preformed composite tube to which the mounting flange and electrical contacts are mounted. One such fuse holder is made by Cooper Power Systems of Pittsburgh, Pa. This fuse holder has the first electrical terminal threadably mounted to the distal end of the tube and the mounting flange threadably mounted to the proximal end of the tube. The second electrical contact is centrally located along the tube and is of a split-ring design which can partially collapse on itself. The second electrical contact has an outwardly extending boss which passes through an opening in the tube. Once the boss is properly positioned, the split ring expands to its full circular shape to serve as the second electrical terminal within the tube.

SUMMARY OF THE INVENTION

The present invention is directed to a current limiting fuse holder used for electrical apparatus, such as distribution transformers, which is relatively simple in construction, easy to assemble, strong and yet provides the necessary high reliability hermetic seal needed.

The fuse holder includes a tubular body having outer or proximal and inner or distal ends. A first electrical contact element is secured to the inner end, preferably by a resilient retaining ring engaging circular grooves formed in the opposed surfaces of the first electrical contact element and the inner surface of the tubular body. A second electrical contact element is secured within the tubular body at a chosen position. The second electrical contact element is preferably a circular tubular member having a flexible contact strap extending from its outer surface and passing through an opening in the tubular body. A mounting flange assembly is secured to the outer end of the body, also using a resilient retaining ring. Fluid-tight seals are provided between the tubular body and the outer surfaces of the first electrical contact element, the second electrical contact element and the mounting flange assembly, preferably using pairs of O-rings. An adhesive can also be used between the outer surfaces of these elements and the inner surface of the body to keep the elements from rotating within the body.

One of the primary advantages of the invention is that it is less complicated to manufacture than conventional fuse holders and can be manufactured at a lower cost with very high quality. Another advantage of the invention over wet-wound fuse holders is that damaged or improperly assembled fuse holders can be disassembled and the components, with the exception of the tube, reused. This is not generally practical with wet-wound fuse holders because of the difficulty of removing the resin from the components. A further advantage of the invention is the elimination of the need to support wet winding manufacturing techniques, such as specialized ventilation needs and specialized training in wet winding manufacturing.

Other features and advantages of the invention will appear from the following description in which the preferred embodiment has been described in detail in conjunction with the accompanying drawings.

DESCRIPTION OF THE PREFERRED EMBODIMENT

Figure 1:
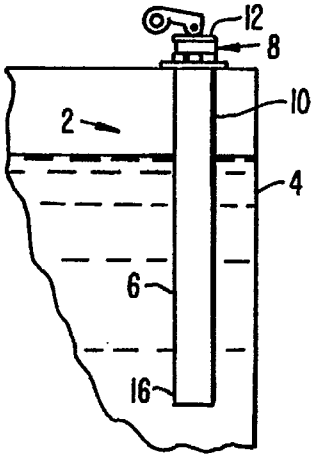
FIG. 1 is a simplified side view showing a fuse holder made according to the invention mounted to the tank of a distribution transformer shown with a top closure sealing the outer end of the fuse holder.

FIG. 1 illustrates a fuse holder 2 mounted to the tank 4 of a distribution transformer. Fuse holder 2 has a tubular body 6 to which a flange assembly 8 is mounted to the outer end 10 of tubular body 6. Flange assembly 8, and thus outer end 10, is closed or sealed by a conventional top closure 12.

Figure 2:
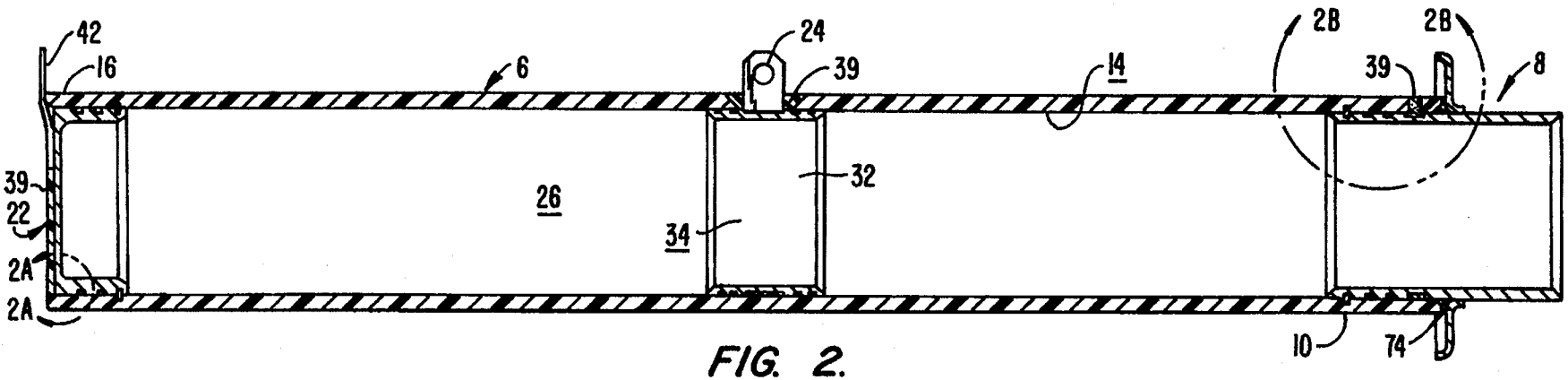
FIG. 2 is a side cross-sectional view of the fuse holder of FIG. 1.
Figure 2A:
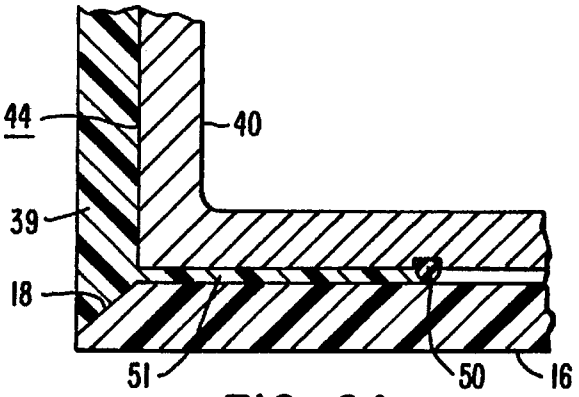
FIGS. 2A and 2B are enlarged views taken along lines 2A—2A and 2B—2B of FIG. 2.
Figure 2B:
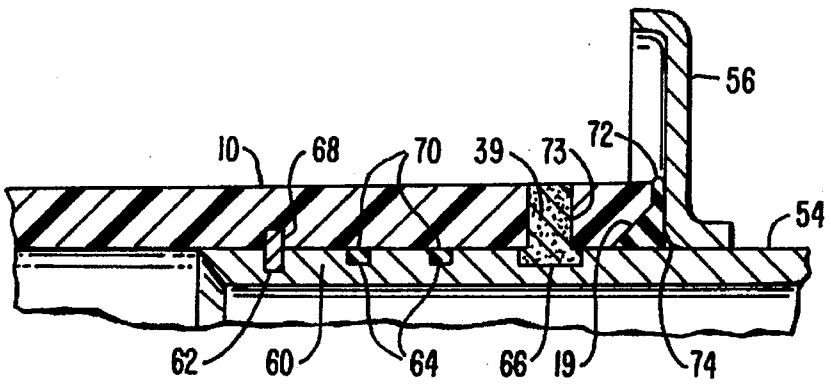
Figure 3:
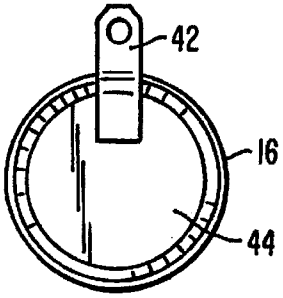
FIG. 3 is an end view of the fuse holder of FIG. 2.
Figure 4:
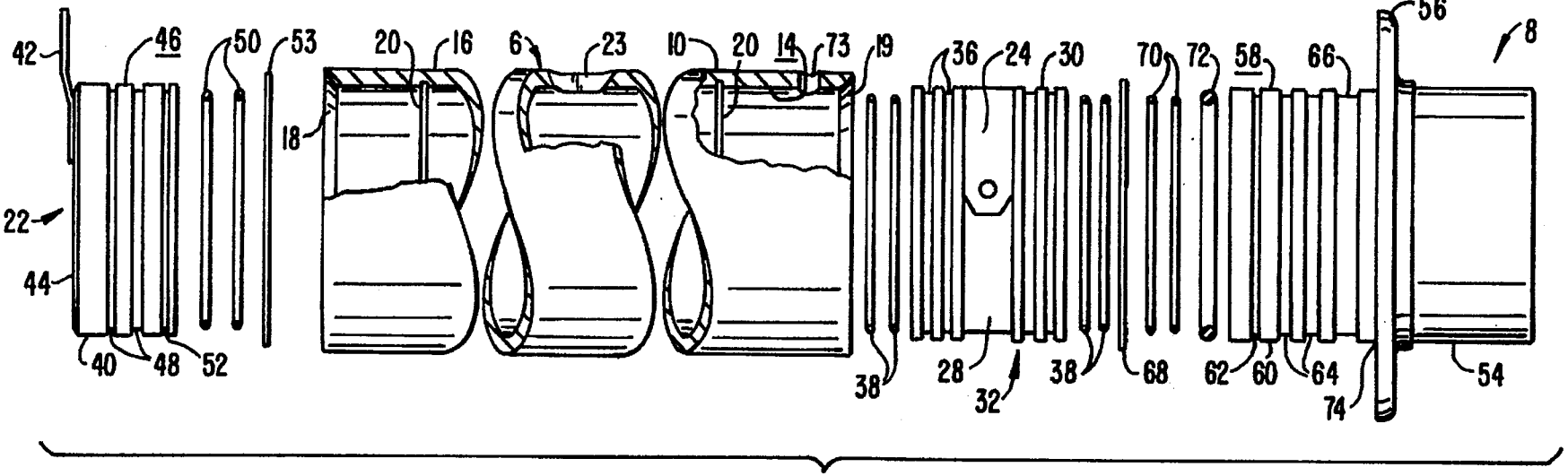
FIG. 4 is an exploded side view, with portions of the tubular body broken away, of the fuse holder of FIG. 2 showing all elements except for the adhesive layers.

Referring also to FIGS. 2–4, tubular body 6 has an epoxy/fiberglass filament wound tubing, such as that made by Janco of Mishawakan, Ind., or Polygon Company of Walkerton, Ind. Tubular body 6 has a relatively smooth, circular cylindrical inner surface 14. Each of the inner (distal) and outer (proximal) ends 16, 10 of tubular body 6 has a chamfered edge 18, 19, respectively. A circumferential groove 20 is formed in inner surface 14 at outer end 10 and at inner end 16. These grooves are used to lock flange assembly 8 to outer end 10 and a first electrical contact element 22 to inner end 16 as will be discussed below.

An oval contact strap opening 23 is formed in tubular body 6 at a chosen location along the body between outer and inner ends 10, 16. Contact strap opening 23 is sized to permit a flexible, second contact strap, which acts as a second terminal 24, to pass through from the interior 26 of tubular body 6 to outside of the tubular body. Second terminal 24 extends from a central groove 28 formed in the outer, circumferentially unbroken cylindrical surface 30 of the second or proximal electrical contact element 32. Element 32 has a smooth cylindrical inner surface 34 and acts as a surface against which a conventional current limiting fuse, not shown, contacts.

Element 32 is preferably made of carbon steel and is tin plated. Carbon steel is used because its coefficient of thermal expansion is closer to that of epoxy/fiberglass tubular body 6 than, for example, stainless steel or copper. Second electrical terminal 24 is tin plated copper and is secured to the base of central groove 28 in outer cylindrical surface 30 of element 32 such as by brazing or using silicon bronze MIG welding. As suggested in FIG. 4, flexible second terminal 24 lies within groove 28 in preparation for contact element 32 being inserted into interior 26 of tubular body 6. When second terminal 24 is axially aligned with contact strap opening 23, contact element 32 is rotated within tubular body 6 until the distal end of second terminal 24 can be directed through contact strap opening 23 to the position of FIGS. 1 and 2.

Contact element 32 includes a pair of O-ring grooves 36 on either side of central groove 28 used to position O-rings 38. O-rings 38 are made of material suitable for use in oil-filled distribution transformers, such as Viton (a fluorelastomer made by DuPont) O-rings from Parker Seal Group of Lexington, Ky. O-rings 38 provide a fluid seal between outer surface 30 of second electrical contact element 32 and inner surface 14 of tubular body 6. Once contact element is in place, adhesive groove 28 is filled, or at least substantially filled, with an adhesive 39, such as an epoxy sold by FEL-PRO, INC. of Commerce City, Colo. as REST-ECH 162/027 epoxy. This can be accomplished by orienting fuse holder 2 in the position of FIG. 2 and pouring preheated (85° C.) epoxy through opening 23 until groove 28 is full. The epoxy is then allowed to cure for an appropriate length of time, such as 16 hours, at, for example, 85° C.

First electrical contact element 22 includes a cupped-shaped member 40. Cupped-shaped member 40 is preferably made from carbon steel and is tin plated. A first, tin plated copper electrical terminal 42 is secured to an outer face 44 of member 40 such as by brazing or welding. Member 40 also has a cylindrical outer surface 46 with a pair of O-ring grooves 48 which accept a pair of Viton O-rings 50. O-rings 50 provide a good seal between cupped-shaped member 40 and inner surface 14 of tubular body 6.

Outer surface 46 has a lock ring groove 52 formed therein sized to accept a resilient retaining ring 53. Ring 53 is preferably a stainless steel retaining ring, such as made by Smalley Steel Ring Co. of Wheeling, Ill. as Part No. VHL-262-DV-502. Ring 53 is sized so that it can be radially compressed to permit cupped-shaped member 40 to be inserted into inner end 16 of tubular body 6 and then axially lock cupped-shaped member 40 within inner end 16 of tubular body 6. Once locked in place, it is not possible to remove first electrical contact element 22 from inner end 16 without at least the partial destruction of fuse holder 2.

To keep cupped-shaped member 40 from rotating within tubular body 6, adhesive 39 is used. To apply adhesive 39, tubular body 6 is oriented so that inner (distal) end 16 faces vertically upwardly. The heated adhesive 39 is then slowly poured onto outer face 44, which lies a small distance below the outer end of chamfered edge 18; the heated adhesive 39 also wicks into-the small gap 51 formed between that portion of outer cylindrical surface 46 between outer face 44 and the first of the two O-ring grooves 48. Adhesive 39 also acts as an electrical insulator for outer face 44, in addition to adhering member 40 to tubular body 6.

Flange assembly 8 includes a cylindrical body 54 having a radially outwardly extending flange collar 56 extending from the outer cylindrical surface 58 of body 54. Body 54 and flange collar 56 are preferably made of stainless steel due to corrosion considerations. Body 54 includes a portion 60 which is mounted within outer end 10 of tubular body 6. Portion 60 has a lock ring groove 62, a pair of O-ring grooves 64 and an adhesive groove 66 formed in outer surface 58. A second resilient retaining ring 68 is housed within lock ring groove 62. A pair of O-rings 70, also made of Viton elastomer, are housed within O-ring grooves 64. Lock ring 68 and O-rings 70 serve the same locking and sealing functions as the corresponding element at inner end 16. Adhesive groove 66 is filled with adhesive 39 through a hole 73 in body 6 in a manner similar to and at the same time as groove 28 is filled. To help prevent adhesive 39 from escaping past chamfered edge 19, an O-ring 72 is captured between chamfered edge 19 and the base 74 of flange collar 56. O-ring 72 can be made of a variety of materials, such as Buna-N elastomer.

The assembly of fuse holder 2 proceeds generally along the above-described manner. However, it has been found that forming circular grooves 20 in inner surface 14 can be tricky. This is true because the outer surface of tubular body 6 is not necessarily even or concentric with inner surface 14. To ensure circular groove 20 is concentric with inner surface 14, tubular body 6 is chucked or held by engaging inner surface 14 rather than the outer surface of the tubular body. Also, it has been found that it is best to mount second electrical contact element 32 within tubular body 6 prior to forming at least one of circular lock ring grooves 20 to prevent possible damage to O-rings 38 as they pass groove 20.

In use, fuse holder 2 is mounted to the tank 4 of a distribution transformer or other electrical apparatus. A current limiting fuse, not shown, is clamped to the inner end of top closure 12 and inserted into interior 26 of tubular body 6. Top closure 12 is then manipulated to provide a good seal with flange assembly 8 to hermetically seal interior 26 from the environment both within and without tank 4 of the transformer. The fuse can then protect against current overload with appropriate leads connected to first and second terminals 42, 24.

Modification and variation can be made to the disclosed embodiment without departing from the subject of the invention as defined in the following claims. For example, a retaining ring 68 could be used with second electrical contact element 32 if desired to axially lock element 32 in position. The various components could be made from different materials. Terminals 42, 24 could be made in forms other than flexible straps.

What is claimed is:

1. A method for assembling a fuse holder comprising the following steps:

selecting a cylindrical tubular body having an inner surface defining an open interior and open first and second ends;

forming an inner circular groove in the inner surface of said body at said first end of said body;

mounting a first electrical contact element, including a first cylindrical portion, to the first end of the body so that at least a part of the first cylindrical portion is within the open interior;

securing the first electrical contact to the first end of the body by engaging a resilient retaining ring, carried by the first cylindrical portion of the first electrical contact element, with the inner circular groove formed in the inner surface at the first end of the body;

mounting a cylindrical tubular second electrical contact element within the body at a chosen location;

securing the second electrical contact element at the chosen location;

mounting a mounting flange assembly, including a second cylindrical portion, to the second end of the body so that at least a part of the second cylindrical portion is within the interior; and securing the mounting flange assembly to the second end of the body.

2. The method of claim 1 wherein the forming step includes the step of holding the tubular body from said inner surface while forming the inner circular groove in the inner surface of the body.

3. The method of claim 1 further comprising the step of forming a second inner circular groove in the inner surface of said body at said second end of said body.

4. The method of claim 3 wherein the mounting flange assembly securing step includes the step of engaging a resilient retaining ring, carried by the second cylindrical portion of the mounting flange assembly, with the second inner circular groove formed in the inner surface at the second end of the body.

5. The method of claim 1 wherein the first electrical contact securing step includes the step of adhering the first cylindrical portion to the inner surface of the body with an adhesive.

6. The method of claim 1 wherein the second electrical contact securing step includes the step of adhering the second electrical contact to the inner surface of the body with an adhesive.

7. The method of claim 1 wherein the flange assembly securing step includes the step of adhering the flange assembly to the inner surface of the body with an adhesive.

8. A method for assembling a fuse holder comprising the following steps:

selecting a cylindrical tubular body having a body wall, an inner surface defining an open interior, open first and second ends and a terminal opening formed through the body wall at a chosen location between the first and second ends;

mounting a first electrical contact element, including a first cylindrical portion, to the first end of the body so that at least a part of the first cylindrical portion is within the open interior;

securing the first electrical contact to the first end of the body;

mounting a circumferentially unbroken cylindrical tubular second electrical contact element within the body at a chosen location by:

aligning the distal end of a flexible terminal, extending from the second electrical contact element, with the terminal opening; and passing the distal end of the flexible terminal through the terminal opening;

securing the second electrical contact element at the chosen location;

mounting a mounting flange assembly, including a second cylindrical portion, to the second end of the body so that at least a part of the second cylindrical portion is within the interior; and securing the mounting flange assembly to the second end of the body.

9. The method of claim 8 wherein the second electrical contact mounting step includes the step of positioning the flexible terminal within an annular recess formed in an outer surface of the tubular second electrical contact element prior to inserting the second electrical contact element into the tubular body through a chosen one of the first and second ends.

10. A method for assembling a fuse holder comprising the following steps:

selecting a cylindrical tubular body having an inner surface defining an open interior and open first and second ends;

forming inner circular grooves in the inner surface of said body at said first and second ends of said body;

mounting a first electrical contact element, including a first cylindrical portion, to the first end of the body so that at least a part of the first cylindrical portion is within the open interior;

securing the first electrical contact to the first end of the body by engaging a resilient retaining ring, carried by the first cylindrical portion of the first electrical contact element, with the inner circular groove formed in the inner surface at the first end of the body;

mounting a cylindrical tubular second electrical contact element within the body at a chosen location by:

positioning a flexible electrical terminal within an annular recess formed in an outer surface of the tubular second electrical contact element prior to inserting the second electrical contact element into the tubular body;

inserting the second electrical contact into the tubular body through a chosen one of the first and second ends;

aligning a free, distal end of the flexible electrical terminal with the terminal opening; and passing the distal end of the flexible electrical terminal through the terminal opening;

securing the second electrical contact element at the chosen location;

mounting a mounting flange assembly, including a second cylindrical portion, to the second end of the body so that at least a part of the second cylindrical portion is within the interior; and securing the mounting flange assembly to the second end of the body by engaging a resilient retaining ring, carried by the second cylindrical portion of the mounting flange assembly, with the inner circular groove formed in the inner surface at the second end of the body.

* * * * *